US005350165A

United States Patent [19]

Nagamoto

[11] Patent Number: 5,350,165

[45] Date of Patent: Sep. 27, 1994

[54] SHEET FEEDING APPARATUS

[75] Inventor: Masayuki Nagamoto, Minoo, Japan

[73] Assignee: Laurel Bank Machines Co., Ltd., Tokyo, Japan

[21] Appl. No.: 105,055

[22] Filed: Aug. 12, 1993

[30] Foreign Application Priority Data

Aug. 31, 1992 [JP] Japan ..... 4-231782

[51] Int. Cl.[5] ..... B65H 1/06

[52] U.S. Cl. ..... 271/9

[58] Field of Search ..... 271/15, 21, 238, 239, 271/161, 171, 109, 9, 165

[56] References Cited

U.S. PATENT DOCUMENTS

| | | | |
|---|---|---|---|
| 3,754,753 | 8/1973 | Gorner et al. . | |
| 4,786,044 | 11/1988 | Moody | 271/171 |
| 4,838,535 | 6/1989 | Yokoi | 271/171 X |
| 5,085,419 | 2/1992 | Bell | 271/171 X |
| 5,127,646 | 7/1992 | Matsuda | 271/171 |

FOREIGN PATENT DOCUMENTS

| | | |
|---|---|---|
| 230548 | 8/1987 | European Pat. Off. . |
| 2109983 | 5/1972 | France . |

OTHER PUBLICATIONS

Patent Abstract of Japan, vol. 8, No. 177 (M-317)(1614) Aug. 1984 re JP 59069322.

*Primary Examiner*—Richard A. Schacher

*Attorney, Agent, or Firm*—Cushman, Darby & Cushman

[57] ABSTRACT

A sheet feeding apparatus is provided including a sheet stacking portion constructed and arranged to receive a plurality of sheets of different sheet widths stacked in a sheet feeding direction in order of width so that the widest sheets are disposed at a lowermost position of the sheet stacking portion; a first pair of guides provided in the sheet stacking portion and being constructed and arranged to restrict a lateral position of the widest sheets along a predetermined path; at least one other pair of guides provided in the sheet stacking portion and being constructed and arranged to restrict a lateral position of sheets having a width narrower than a width of the widest sheets along a predetermined path and to contact an upper surface of a sheet of the widest sheets disposed immediately beneath the narrower sheets; and at least one feeder constructed and arranged to move successive sheets of the plurality of sheets from the stacking portion such that the widest sheets are first moved from the stacking portion until all sheets of the widest sheets are moved and thereafter the feeder moving the narrower sheets.

8 Claims, 3 Drawing Sheets

SHEET FEEDING APPARATUS

BACKGROUND OF THE INVENTION

The present invention relates to a sheet feeding apparatus and, in particular, to a sheet feeding apparatus comprising a sheet stacking portion on which a plurality of sheets of different sheet width in the sheet feeding direction are set by stacking the sheets in order from the widest sheets so that the widest sheets are set at the lowermost position, more particularly to such a sheet feeding apparatus adapted for feeding the sheets with the lateral position of the widest sheets restricted along a desired path by a pair of guide means provided in the sheet stacking portion and capable of feeding all of the sheets of different width along desired paths.

DESCRIPTION OF PRIOR ART

A bill counting apparatus or other such bill handling machine, a facsimile machine, or the like is normally provided with a pair of guide means for restricting the position of the bills or sheets in the direction perpendicular to the feeding direction in order to feed the bills or sheets along the desired paths.

In such a bill counting apparatus or other such bill handling machine, facsimile machine or the like, when sheets of different width in the feeding direction are fed into the machine or apparatus together, the bills or sheets are ordinarily in order from widest bills or sheets so as to set the widest bills or sheets in the lowermost position and to abut a pair of guide means against the opposite side portions of the widest bills or sheets, thereby restricting the lateral position thereof by the pair of guide means and feeding the bills or sheets along the desired paths into the machine or apparatus.

However, during the feeding of sheets into the bill handling machine or the facsimile apparatus, while the position of the bills or sheets having the largest width in the direction perpendicular to the feeding direction is being restricted by the pair of guide means, it is difficult for the pair of guide means to restrict the positions of the narrower bills or sheets stacked on the widest bills or sheets in the direction perpendicular to the feeding direction. As a result, the narrower bills or sheets move in the direction perpendicular to the feeding direction between the pair of guide means due to vibration or the like produced by the operation of the bill counting apparatus or other such bill handling machine, the facsimile machine, or the like, and the bills or sheets are sometimes not fed to the inside of the machine or apparatus along the desired paths.

In the bill counting apparatus or other such bill handling machine, therefore, the bills are fed along paths that deviate from the path expected by a sensor for discriminating the denominations of the bills, and whether or not the bills are acceptable, the sensors sometimes erroneously discriminate and erroneously count the bills. Similarly, in a facsimile machine, a part of the document or image is sometimes not transmitted.

This problem can be solved by classifying the bills or sheets into groups each consisting of bills or sheets of the same width in the feeding direction and serially feeding the bills or sheets into the bill counting apparatus or other such bill handling machine, the facsimile machine or the like. However, it is inefficient to feed the bills or sheets serially.

SUMMARY OF THE INVENTION

It is, therefore, an object of the present invention to provide a sheet feeding apparatus capable of feeding sheets of different width along desired paths.

The above and other objects of the present invention can be accomplished by a sheet feeding apparatus which comprises a sheet stacking portion on which a plurality of sheets of different sheet width in the sheet feeding direction are set by stacking the sheets in order from the widest sheets so that the widest sheets are set at the lowermost position and is adapted for feeding the sheets with the lateral position of the widest sheets restricted along a desired path by a pair of guide means provided in the sheet stacking portion. The sheet feeding apparatus further includes a pair or pairs of sheet guide means of a number which is not less than the number of kinds of sheets whose width differ from the largest width, each pair of the sheet guide means being adapted for restricting the lateral position of sheets having the corresponding width along a desired path and for always contacting the upper surface of the sheets set immediately beneath the sheets having the corresponding width.

In a preferred aspect of the present invention, the pair of guide means is adapted for restricting the lateral position of the widest sheets by abutting opposite side portions of the widest sheets and each pair of the sheet guide means is adapted for restricting the lateral position of sheets having the corresponding width by abutting opposite side portions thereof.

In a further preferred aspect of the present invention, each of the sheet guide means is adapted for always contacting the upper surface of the sheets set immediately beneath the sheets having the corresponding width by the dead weight thereof.

In another preferred aspect of the present invention, the sheets are bills and a bill feeding apparatus comprises a bill stacking portion on which a plurality of bills of different widths are set in the bill feeding direction by stacking the bills in order from the widest bills so that the widest bills are set at the lowermost position and is adapted for feeding the bills with a lateral position of the widest bills restricted along a desired path by a pair of guide means provided in the bill stacking portion, said bill feeding apparatus further including a pair or pairs of bill guide means in a number which is not less than the number of kinds of bills whose width differ from the largest width, each pair of the bill guide means being adapted for restricting the lateral position of bills having the corresponding width along a desired path and for always contacting the upper surface of the bills set immediately beneath the bills having the corresponding width.

In a further preferred aspect of the present invention, the pair of guide means is adapted for restricting the lateral position of the widest bills by abutting opposite side portions of the widest bills and each pair of the bill guide means is adapted for restricting the lateral position of bills having the corresponding width by abutting opposite side portions thereof.

In a still further preferred aspect of the present invention, each pair of the bill guide means is adapted for always contacting the upper surface of the bills set immediately beneath the bills having the corresponding width by the dead weight thereof.

DESCRIPTION OF THE PREFERRED EMBODIMENT

Figure 1:
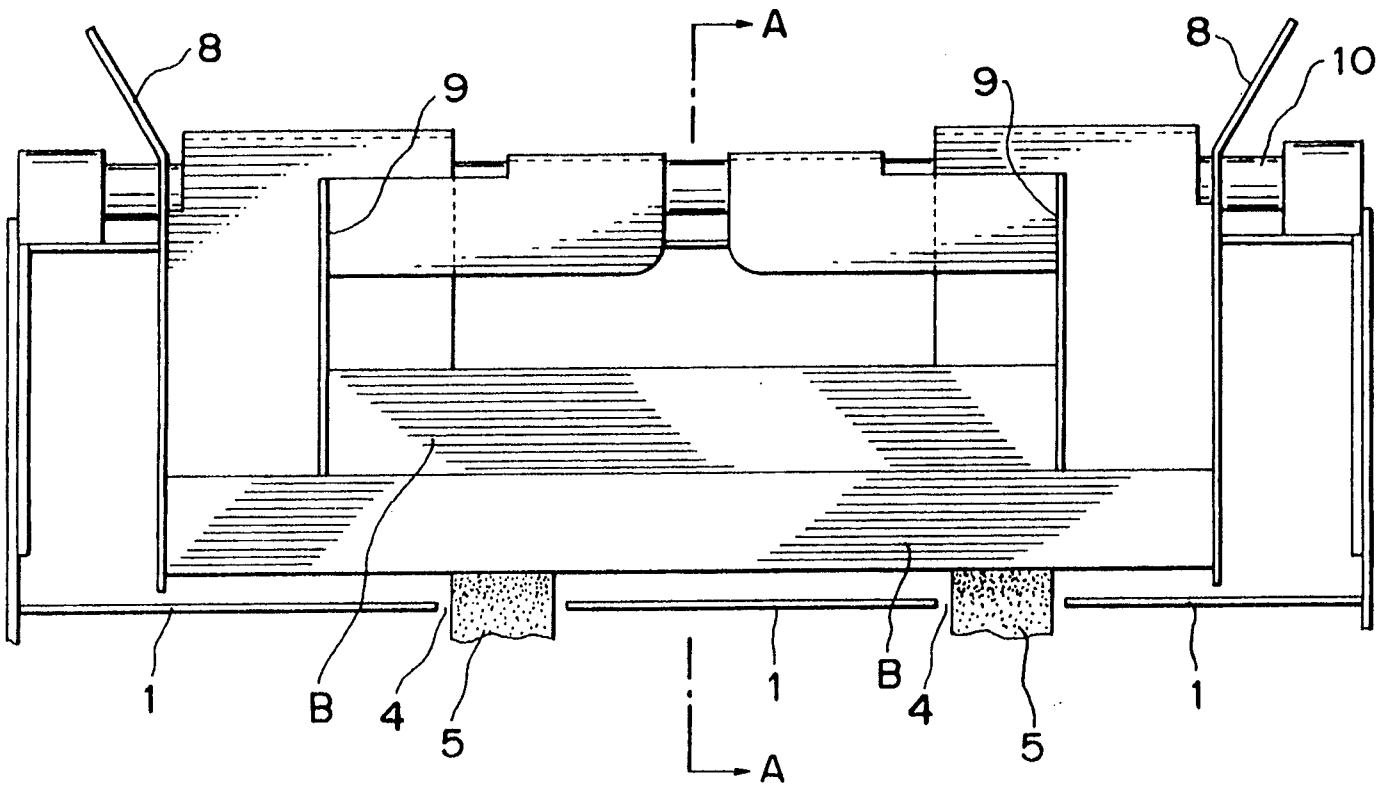
FIG. 1 is a schematic front view of a bill counting apparatus including a bill feeding apparatus which is an embodiment of the present invention.
Figure 2:
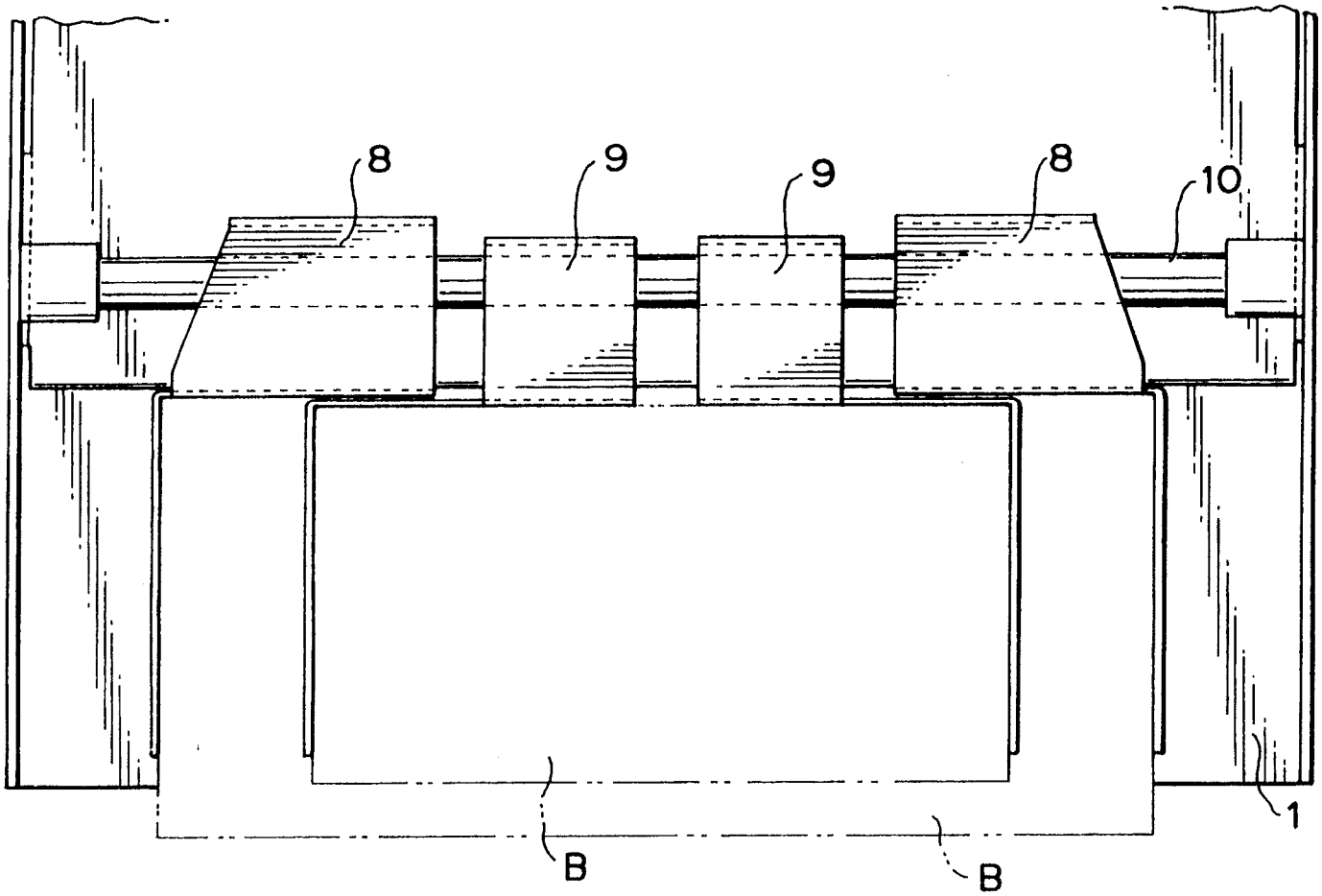
FIG. 2 is a schematic plan view of a bill counting apparatus including a bill feeding apparatus which is an embodiment of the present invention.
Figure 3:
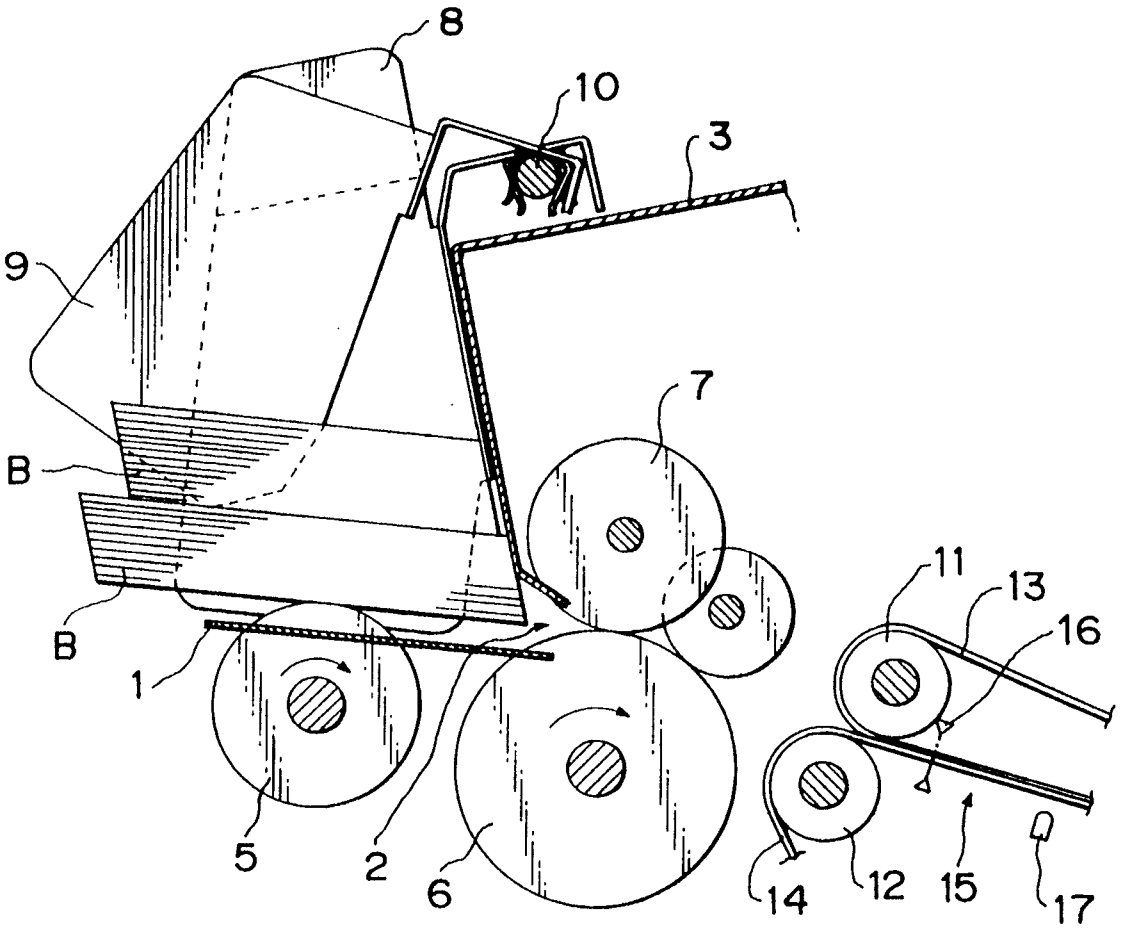
FIG. 3 is a schematic cross-sectional view taken along a line A—A in FIG. 1.

Referring to FIGS. 1 to 3, a bill feeding apparatus for a bill counting apparatus, which is an embodiment of the present invention, comprises a bill stacking plate 1 on which bills B to be counted are stacked, a front plate 3 for forming a gap 2 for feeding out the bills B between the bill stacking plate 1 and itself, feed-out rollers 5 which are provided so as to partly project upwardly from an opening 4 formed in the bill stacking plate 1 and are rotated so as to feed the bills stacked on the bill stacking plate 1 into the bill counting apparatus via the gap 2, take-out rollers 6 which are rotated in synchronism with the feed-out rollers 5 for further feeding the bills B fed out from the bill stacking plate 1 by the feed-out rollers 5 into the bill counting apparatus, and separation rollers 7 which cooperate with the take-out rollers 6 for preventing two or more bills B from being fed into the bill counting apparatus simultaneously. In this embodiment, the separation rollers 7 are held stationary and at least a periphery thereof facing the take-out rollers 6 is formed with a friction portion (not shown) formed with a friction material.

The bill counting apparatus according to this embodiment is constituted so as to feed two kinds of bills B which differ in width into the bill counting apparatus. For this purpose, the bill counting apparatus is provided with a pair of first guides 8 for restricting the lateral position of the bills B of the denomination having wider width and a pair of second guides 9 for restricting the lateral position of the bills B of the denomination having narrower width. As shown in FIGS. 1 and 3, the pair of first guides 8 are mounted rotatably and slidably in the widthwise direction on a shaft 10 so that the distance therebetween can be adjusted in accordance with the width of the bills of the denomination having wider width to be guided and the front edge portions thereof can abut against the rear surface of the front plate 3. Since the first guides 8 are held in such a manner that the front edge portions thereof abut against the rear surface of the front plate 3, they are formed so that the lower edge portions thereof can be positioned lower than the lowermost bill B among the wider bills B lifted by the feed-out rollers 5 which are provided so as to partly project from the opening 4 formed in the bill stacking plate 1. Further, as shown in FIGS. 1 and 3, the pair of second guides 9 are mounted rotatably and slidably along the shaft 10 on the shaft 10 so that the distance therebetween can be adjusted in accordance with the width of the narrower bills B and the lower edge portions thereof abut against the upper surface of the uppermost bill B of the denomination having a wider width, by the dead weight thereof.

As shown in FIG. 3, a pair of endless belts 13, 14 are respectively wound around pulleys 11, 12 in the bill counting apparatus downstream of the take-out rollers 6, thereby forming a bill transporting portion 15. The bills B fed into the bill counting apparatus by the take-out rollers 6 are further fed into the bill counting apparatus while they are being held by the pair of endless belts 13, 14. The bill transporting portion 15 is provided with an optical sensor 16 and a magnetic sensor 17 for discriminating denominations of the bills B, whether or not the bills B are acceptable, and for counting the number of the bills B.

In the thus constituted bill counting apparatus according to this embodiment, at first, the bills B are set on the bill stacking plate 1 so that the bills B of the denomination having wider width are stacked in a lower position and that the bills B of the denomination having narrower width are stacked in a upper position. Then, the first guides 8 are slid along the shaft 10 until they come into abutment against opposite side portions of the bills B of the denomination having wider width and the front edge portions thereof are caused to abut against the rear surface of the front plate 3 where they are held. Further, the second guides 9 are slid along the shaft 10 until they come into abutment against opposite side portions of the bills B of the denomination having narrower width and they are caused to contact the uppermost bill B of the denomination having wider width, by the dead weight thereof, and are held at that position.

Afterward, when the feed-out rollers 5 are rotated at a predetermined timing, a friction force is applied from the feed-out rollers 5 disposed so as to project upwardly from the opening 4 of the bill stacking plate 1 to the lower surface of the lowermost wider bill B among the wider bills B set in the lower position and the bill B is fed out into the bill counting apparatus through the gap 2 formed by the bill stacking plate 1 and the front plate 3. Further, a friction force is applied to the bill B from the take-out rollers 6 rotated in synchronism with the feed-out rollers 5, whereby the bill B is further fed into the bill counting apparatus toward the bill transporting portion 15. At this time, since the stationary separation rollers 7 apply a friction force whose direction is opposite to the transporting direction of bills B to the upper surface of the bill B, even if two or more bills B have been simultaneously fed out by the feed-out rollers 5, they are separated into individual bills B and, therefore, two or more overlapped bills B are prevented from being fed into the bill counting apparatus.

When the bill B of the denomination having wider width is fed out by the feed-out rollers 5 through the gap 2 in this manner, since the first guides 8 abut against the opposite side portions of the bill B of the denomination having wider width and the lateral position thereof is restricted, it is ensured that the bill B of the denomination having wider width is fed into the bill counting apparatus along a predetermined path.

The bill B of the denomination having wider width fed into the bill counting apparatus by the feed-out rollers 5 and take-out rollers 6 in this manner is fed to the bill transporting portion 15 and is further fed downstream in the bill counting apparatus while they are being held by the pair of endless belts 13, 14. At this time, the optical sensor 16 and the magnetic sensor 17 discriminate the denomination of the bill B and whether or not the bill B is acceptable and count the bill B. In this embodiment, as described above, since the lateral position of the bill B of the denomination having wider width is restricted by the pair of first guides 8 when it is fed out by the feed-out rollers 5, the bill B is fed into the bill counting apparatus along a desired path. Therefore, it is possible to prevent the optical sensor 16 and the magnetic sensor 17 from erroneously discriminating and counting the bill B because the bill B of the denomination having wider width has deviated from the desired path and passed through the wrong portion of the optical sensor 16 and the magnetic sensor 17.

Since the distance between a pair of second guides 9 is determined in such a manner that they abut against the opposite side portions of the bills B of the denomination having narrower width and the lower edge portions thereof contact the upper surface of the uppermost bill B among the bills B of the denomination having a wider width, by the dead weight thereof, each time a bill B of the denomination having a wider width is fed, the pair of second guides 9 is lowered while maintaining contact with the upper surface of the uppermost bill B of the denomination having the wider width and continues to restrict the lateral position of the bills B of the denomination having the narrower width during the time period when the bills B of the denomination having the wider width are being fed into the bill counting apparatus. Therefore, even though vibration or the like may act on the bills B of the denomination having the narrower width during the time period when the bills B of the denomination having the wider width are being fed into the bill counting apparatus, it is possible to prevent the position of the bills B of the denomination having the narrower width from deviating in the direction perpendicular to the bill feeding direction. When all bills B of the denomination having a wider width have been fed into the bill counting apparatus, the pair of second guides 9 comes into contact with the upper surface of the bill stacking plate 1. Thereafter, the pair of second guides 9 restricts the lateral position of the bills B of the denomination having the narrower width while maintaining contact with the upper surface of the bill stacking plate 1. As a result, after all bills B of the denomination having the wider width have been fed into the bill counting apparatus, the bills B of the denomination having the narrower width are fed into the bill counting apparatus through the gap 2 by the feed-out rollers 5 with the lateral position thereof restricted by the pair of second guides 9.

Therefore, since the narrower bills B are fed into the bill counting apparatus along a desired path and are prevented from deviating from the desired path, it is possible to accurately discriminate the denominations of the bills B and, whether or not the bills B are acceptable, to accurately count the number of the bills B by the optical sensor 16 and the magnetic sensor 17.

According to this embodiment, since in addition to the pair of first guides 8 which abuts against the opposite side portions of the bills B of the denomination having the wider width and restricts the lateral position thereof, there are provided the pair of second guides 9 which abuts against the opposite side portions of the bills B of the denomination having the narrower width and maintains their lower edge portions in contact with the upper surface of the uppermost bill B among the bills B of the denomination having the wider width by the dead weight thereof, even if vibration or the like acts on the bills B of the denomination having the narrower width during the time period when the bills B of the denomination having the wider width are being fed into the bill counting apparatus by the feed-out rollers 5 and the take-out rollers 6 rotated in synchronism with each other, the lateral position of the bills B of the denomination having the narrower width is always restricted by the pair of second guides 9. Therefore, the bills B of the denomination having the narrower width stacked on the bills B of the denomination having the wider width can be fed into the bill counting apparatus along a desired path and it is possible to accurately discriminate the denominations of the narrower bills B and, whether or not they are acceptable, to accurately count the number of the narrower bills B by the optical sensor 16 and the magnetic sensor 17.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although the bill feeding apparatus is constituted so as to feed two kinds of bills B, each of a different width into the bill counting apparatus, the present invention can be applied to a bill feeding apparatus for feeding three or more kinds of bills B of different widths in the direction perpendicular to the feeding direction. In this case, an additional pair of guides is be provided for each denomination of bills B other than the denomination of the widest bills B so that each pair of the guides abuts against the opposite side portions of the corresponding denomination of bills B so as to be able to restrict the lateral position thereof and contacts the upper surface of the uppermost bill B among the denomination of bills B stacked immediately beneath the corresponding denomination of bills B by the dead weight thereof.

Further, in the above described embodiment, the first guides 8 are formed so that the lower edge portions thereof are positioned lower than the lowermost bill B among the wider bills B lifted by the feed-out rollers 5 provided so as to partly project from the opening 4 formed in the bill stacking plate 1 when the front edge portions thereof abut against the rear surface of the front plate 3 and is held there. However, the first guides 8 may be disposed so as to abut against the upper surface of the bill stacking plate 1.

Furthermore, in the above described embodiment, although the second guides 9 are constituted so as to be able to contact the upper surface of the uppermost bill B among the bills B of the denomination having the wider width, by the dead weight thereof, if the bills B of the denomination having the wider width can be fed into the bill counting apparatus through the gap 2 by the rotation of the feed-out rollers 5, they may abut the upper surface of the uppermost bill B among the bills B of the denomination having the wider width by a biasing means such as a spring. This can be similarly applied to the guides for bills B other than the widest bills B in the case where three or more kinds of bills of different width are fed into the bill counting apparatus.

Further, although the separation rollers 7 are held stationary in the above described embodiment, the separation rollers 7 may be rotated in the same direction as the takeout rollers 6.

Moreover, although the above described embodiment relates to a bill feeding apparatus for the bill counting apparatus, the present invention can be applied to bill feeding apparatuses for all type of bill handling machines.

Further, although the present invention can be preferably applied to an apparatus such as a bill feeding apparatus for a bill counting apparatus in which sheets are fed at high speed, the present invention can be widely applied to any sheet feeding apparatus such as for a facsimile machine or a copying machine in which a plurality of sheets of different widths in the direction perpendicular to the feeding direction may be set together and fed.

According to the present invention, it is possible to provide a sheet feeding apparatus capable of feeding sheets of different width along desired paths.

I claim:

1. A sheet feeding apparatus comprising:

a sheet stacking portion constructed and arranged to receive a plurality of sheets of different sheet widths stacked in a sheet feeding direction in order of width so that the widest sheets are disposed at a lowermost position of said sheet stacking portion, a first pair of guides provided in said sheet stacking portion and being constructed and arranged to restrict a lateral position of said widest sheets along a predetermined path, at least one other pair of guides provided in said sheet stacking portion and being constructed and arranged to restrict a lateral position of sheets having a width narrower than a width of said widest sheets along a predetermined path and to contact an upper surface of a sheet of said widest sheets disposed immediately beneath the narrower sheets, and at least one feeder constructed and arranged to move successive sheets of said plurality of sheets from said stacking portion such that said widest sheets are first moved from said stacking portion until all sheets of said widest sheets are moved and thereafter said feeder moving said narrower sheets.

2. A sheet feeding apparatus in accordance with claim 1 wherein the first pair of guides is constructed and arranged to restrict the lateral position of the widest sheets and said at least one other pair of guides is adapted for restricting the lateral position of the narrower sheets by abutting opposite side portions thereof.

3. A sheet feeding apparatus in accordance with claim 1 wherein said at least one other pair of guides is constructed and arranged to contact the upper surface of said sheet set immediately beneath the narrower sheets by a dead weight thereof.

4. A sheet feeding apparatus in accordance with claim 2 wherein said at least one other pair of guides is constructed and arranged to contact an upper surface of said sheet set immediately beneath the narrower sheets by a dead weight thereof.

5. A bill feeding apparatus comprising:

a bill stacking portion constructed and arranged to receive a plurality of bills of different bill widths stacked in a bill feeding direction in order of width so that the widest bills are disposed at a lowermost position of said bill stacking portion, a first pair of guides provided in said bill stacking portion and being constructed and arranged to restrict a lateral position of said widest bills along a predetermined path, at least one other pair of guides provided in said bill stacking portion and being constructed and arranged to restrict a lateral position of bills having a width narrower than a width of said widest bills along a predetermined path and to contact an upper surface of a bill of said widest bills disposed immediately beneath the narrower bills, and at least one feeder constructed and arranged to move successive bills of said plurality of bills from said stacking portion such that said widest bills are first moved from said stacking portion until all bills of said widest bills are moved and thereafter said feeder moving said narrower bills.

6. A bill feeding apparatus in accordance with claim 5, wherein the first pair of guides is constructed and arranged to restrict the lateral position of the widest bills and said at least one other pair of guides is adapted for restricting the lateral position of the narrower bills by abutting opposite side portions thereof.

7. A bill feeding apparatus in accordance with claim 5, wherein said at least one other pair of guides is constructed and arranged to contact the upper surface of said bill set immediately beneath the narrower bills by a dead weight thereof.

8. A bill feeding apparatus in accordance with claim 7 wherein said at least one other pair of guides is constructed and arranged to contact an upper surface of said bill set immediately beneath the narrower bills by a dead weight thereof.

* * * * *